US006142107A

United States Patent [19]

Stutzenberger

[11] Patent Number: 6,142,107

[45] Date of Patent: Nov. 7, 2000

[54] FUEL INJECTION SYSTEM FOR AN INTERNAL COMBUSTION ENGINE

[75] Inventor: Heinz Stutzenberger, Vaihingen, Germany

[73] Assignee: Robert Bosch GmbH, Stuttgart, Germany

[21] Appl. No.: 09/331,477

[22] PCT Filed: Jul. 1, 1998

[86] PCT No.: PCT/DE98/01816

§ 371 Date: Aug. 2, 1999

§ 102(e) Date: Aug. 2, 1999

[87] PCT Pub. No.: WO99/20890

PCT Pub. Date: Apr. 29, 1999

[30] Foreign Application Priority Data

Oct. 22, 1997 [DE] Germany ..... 197 46 491

[51] Int. Cl.[7] ..... F02M 37/04

[52] U.S. Cl. ..... 123/27 GE; 123/575

[58] Field of Search ..... 123/25 R, 25 C, 123/25 J, 27 GE, 575, 447

[56] References Cited

U.S. PATENT DOCUMENTS 5,355,854 10/1994 Aubee ..... 123/27 GE
5,762,033 6/1998 Rembold et al. ..... 123/25 R
5,887,566 3/1999 Glauber et al. ..... 123/27 GE
5,890,459 6/1998 Hedrick et al. ..... 123/526

*Primary Examiner*—Thomas N. Moulis
*Attorney, Agent, or Firm*—Ronald E. Greigg; Edwin E. Greigg

[57] ABSTRACT

A fuel injection system with a common rail pressure reservoir which is filled with fuel at high pressure, and a dual substance nozzle for dual-fluid injection of fuel and a supplementary liquid into an internal combustion engine. The system includes a 2/2-way valve in the injection line between the common rail pressure reservoir and a pressure chamber surrounding the nozzle needle of the dual substance nozzle. A pressure fluid container with supplementary liquid under pressure, which via a storage valve can charge the supplementary liquid line with a respective predeterminable quantity of supplementary liquid and that in turn can be charged with supplementary liquid by means of a pump via a check valve and its internal pressure can be kept at a desired level by a pressure regulating valve. As a result, the otherwise usual, technologically substantially more complex 3/2-way magnet control valves can be replaced by a single, less expensive 2/2-way valve. At the same time, the possibility is created of shifting the metering for the supplementary liquid to a single metering valve that serves an entire group of injection valves.

20 Claims, 1 Drawing Sheet

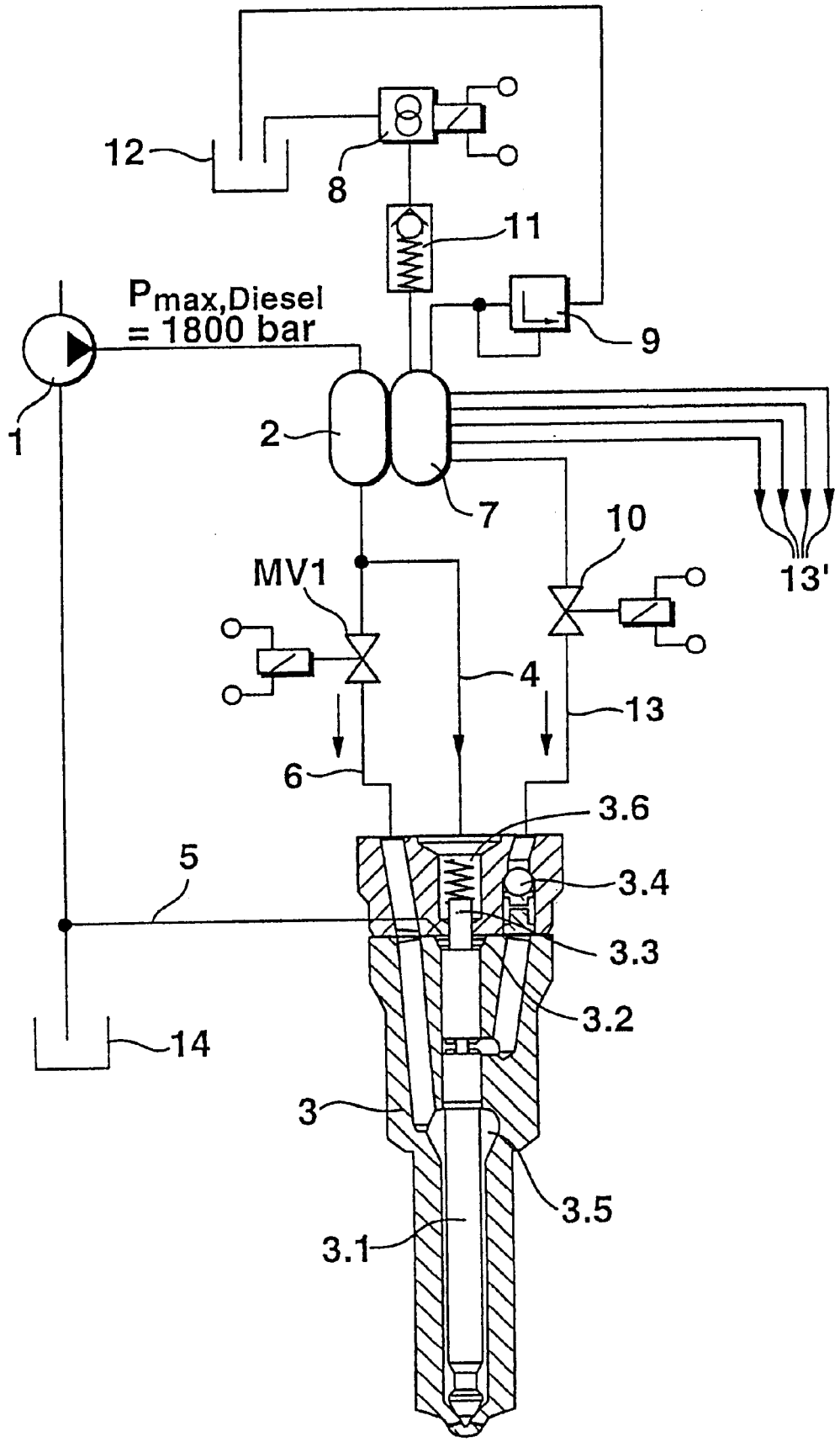
12
8
11
$P_{max,Diesel}$
= 1800 bar
9
1
2
7
10
13'
MV1
4
13
6
3.6
5
3.4
3.3
3.2
14
3
3.5
3.1

FUEL INJECTION SYSTEM FOR AN INTERNAL COMBUSTION ENGINE

PRIOR ART

The invention is based on a fuel injection system for an internal combustion engine.

Such fuel injection systems are known for instance from German patent DE 43 37 048 C2. In it, on the one hand a dual substance nozzle is provided that serves the purpose of laminated injection of fuel and a supplementary liquid, such as diesel fuel and water, so as to reduce pollutant emissions from the engine and possibly to increase its efficiency. On the other hand, in the known injection system, the so-called common rail technique is employed, in which all the injection nozzles serving the engine are charged with fuel at high pressure from a common rail pressure reservoir.

In the known fuel injection system, one complicated and relatively expensive 3/2-way valve is needed for each individual injector for metering the quantity of supplementary liquid, as well as one further 3/2-way valve for controlling the diesel injection quantity. For prestorage of the supplementary liquid, the fuel delivery from the common rail pressure reservoir to the injection nozzle is disrupted using the first 3/2-way valve and at the same time a pressure chamber surrounding the md and in which fuel at high pressure is stored is drained off to the low- pressure fuel side by means of a suitable position of the first 3/2-way valve. By means of the resultant pressure drop in the pressure chamber, supplementary liquid is fed via a suitable line into the pressure chamber and positively displaces the equivalent volume of fuel. Next, the first 3/2-way valve is returned to a position that establishes a communication between the common rail pressure reservoir and the pressure chamber in the injection valve. For quantitatively precise metering of the fuel quantity to be injected and that is intended to follow the prestored supplementary liquid in the injection surge caused by the next valve opening, the further 3/2-way magnet valve is provided, which selectively connects the back end of the nozzle needle, which is held in the closing position by a spring, selectively with either the common rail pressure reservoir or the low-pressure fuel side and as a result chronologically controls the valve needle stroke, the opening and closing of the valve, and thus the desired injection quantity.

In principle, the known fuel injection system for each individual injector requires the two precise and thus complicated 3/2-way control magnet valves, so that both the desired fuel quantity and the required quantity of supplementary liquid can be metered exactly.

ADVANTAGES OF THE INVENTION

The fuel injection system according to the invention, to simplifies its structure and thus makes it more economical produce. As a result, the two complicated and expensive 3/2-way magnet control valves can be replaced with a single, simpler and less expensive 2/2-way valve, because the quantity metering for the supplementary liquid is functionally and structurally separated from the component units for fuel injection. By using the pressure fluid container for supplementary liquid according to the invention, the advantages known from the common rail technique for fuel injection can be exploited. In particular, a plurality of supplementary liquid lines each leading to different dual substance nozzles can lead away from the pressure fluid container, and only a single valve unit can be provided to provide an entire group of dual substance nozzles with supplementary liquid.

BRIEF DESCRIPTION OF THE DRAWING

One exemplary embodiment of the fuel injection system for internal combustion engines according to the invention is shown in the drawing and will be described in the ensuing description. The drawing shows a schematic circuit diagram of an exemplary embodiment of the fuel injection system of the invention, along with a pressure fluid container for a supplementary liquid.

DESCRIPTION OF THE EXEMPLARY EMBODIMENT

In the exemplary embodiment, shown in the drawing, of the fuel injection system of the invention for an internal combustion engine for dual-fluid injection of fuel (as a rule, diesel fuel) and a supplementary liquid (as a rule, water), a to high-pressure pump 1 supplies a common rail pressure reservoir 2 with fuel from a tank 14 at a pressure level of approximately 1800 bar. Between the common rail pressure reservoir 2 and a pressure chamber 3.5, which surrounds the nozzle needle 3.1 of a dual substance nozzle 3 and is to be supplied with fuel from the common rail pressure reservoir via an injection line, a quantity metering component must now be disposed, since after all, the classical injection pump that was typical earlier has been replaced by the combination of a common rail pressure reservoir 2 and the simpler high-pressure pump 1, and the rail pressure is always available at a certain level. This task is taken over, in the arrangement of the invention, by a 2/2-way valve MV1. This valve should be designed as a high- speed magnet valve with good replicability and a more or less fluid transition between its two extreme positions, since a chronologically configurable course of injection quantity may possibly be needed. The precise quantity metering is made possible by way of the known (measured or controlled) pressure drop between the common rail pressure reservoir 2 and the engine combustion chamber to be supplied by the dual substance nozzle 3, by means of a precise time slot, whose size depends on other factors, by way of an electrical triggering means that is not shown in the drawing.

Except for minor details, the design and mode of operation of the dual substance nozzle 3 used is known from the prior art. In the system of the invention, however, a small piston 3.3 is additionally provided on the axial butt end, remote from the tip, of the nozzle needle (injector tappet) 3.1; this piston protrudes with-its end remote from the nozzle needle 3.1 into a chamber 3.6, which via a line 4 communicates directly with the common rail pressure reservoir 2 and is acted upon by the high pressure prevailing there. As a result, in order to move the injector tappet 3.1, essentially the same resistance force must always be overcome, since now because of the constant piston area ratios and the preclusion of the influence of the absolute pressure in the common rail pressure reservoir 2, only a constant spring pressure needs to be overcome by a pressure pulse from the (variable) rail pressure. As a result, virtually constant switching times (motion time of the injector tappet) ensue, which are much more convenient from the standpoint of control technology. For venting the chamber 3.2 that receives the axial butt end of the nozzle needle 3.1 and that is sealed off against high pressure from the chamber 3.6, a vent line 5 leading to the low-pressure fuel side is provided.

The injection of supplementary liquid into the dual substance nozzle 3 is effected from a pressure fluid container 7 via a storage valve 10, which is capable of opening or closing a supplementary liquid line 13 leading to a check valve 3.4 in the dual substance nozzle 3. The pressure fluid container 7 is charged with supplementary liquid by a pump 8 from a supply container 12 via a check valve 11. The pressure in the pressure fluid container 7 is kept at a desired level via a pressure regulating valve 9.

In the exemplary embodiment shown in the drawing, the common rail pressure reservoir 2 for the fuel and the pressure fluid container 7 for the supplementary liquid are embodied integrally, in order to economize on space in the engine compartment.

A plurality of supplementary liquid lines, each leading to different dual substance nozzles can lead away from the pressure fluid container 7; in the drawing, they are all designated by reference numeral 13'. It is possible in each case to provide only a single valve unit for charging an entire group of dual substance nozzles with supplementary liquid; this unit must then be designed as a suitable multiposition valve. It is also possible for a plurality of injectors to be charged with fuel via suitable valve units from the common rail pressure reservoir.

The pump 8 for charging the pressure fluid container 7 with supplementary liquid may be an electrically operated pump, such as a two-stage gear pump, which is capable of pumping supplementary liquid at a pressure level of up to about 50 bar.

The pressure fluid container 7 according to the invention for supplementary liquid can be used in engines with the most various numbers of cylinders and for injection systems of the most variable design.

The foregoing relates to preferred exemplary embodiments of the invention, it being understood that other variants and embodiments thereof are possible within the spirit and scope of the invention, the latter being defined by the appended claims. The foregoing relates to preferred exemplary embodiments of the invention, it being understood that other variants and embodiments thereof are possible within the spirit and scope of the invention, the latter being defined by the appened claims.

What is claimed is:

1. A fuel injection system for an internal combustion engine comprising a high-pressure pump (1) for pumping the fuel into a dual substance nozzle (3), and having a pumping device for pumping a supplementary liquid, carried via a check valve (3.4) into a supplementary liquid line (15) leading to the dual substance nozzle (3), a pressure fluid container (7) with supplementary liquid under pressure is provided, which via a storage valve (10) can charge the supplementary liquid line (13) with a predeterminable quantity of supplementary liquid, and which in turn can be charged with supplementary liquid via a check valve (11) by means of a pump (8) and whose internal pressure can be kept at a desired level by means of a pressure regulating valve (9).

2. The fuel injection system according to claim 1, in which the pump (8) has an electric drive.

3. The fuel injection system according to claim 1, in which the pump (8) is a two-stage gear pump.

4. The fuel injection system according to claim 2, in which the pump (8) is a two-stage gear pump.

5. The fuel injection system according to claim 1, in which a common rail pressure reservoir (2) is filled with fuel at high pressure said reservoir can charge an injection line (6) leading to the dual substance nozzle (3) with fuel.

6. The fuel injection system according to claim 2, in which a common rail pressure reservoir (2) is filled with fuel at high pressure said reservoir can charge an injection line (6) leading to the dual substance nozzle (3) with fuel.

7. The fuel injection system according to claim 3, in which a common rail pressure reservoir (2) is filled with fuel at high pressure said reservoir can charge an injection line (6) leading to the dual substance nozzle (3) with fuel.

8. The fuel injection system according to claim 4, in which a common rail pressure reservoir (2) is filled with fuel at high pressure said reservoir can charge an injection line (6) leading to the dual substance nozzle (3) with fuel.

9. The fuel injection system according to claim 5, in which the pressure fluid container (7) for supplementary liquid and the common rail pressure reservoir (2) are embodied integrally.

10. The fuel injection system according to claim 6, in which the pressure fluid container (7) for supplementary liquid and the common rail pressure reservoir (2) are embodied integrally.

11. The fuel injection system according to claim 7, in which the pressure fluid container (7) for supplementary liquid and the common rail pressure reservoir (2) are embodied integrally.

12. The fuel injection system according to claim 8, in which the pressure fluid container (7) for supplementary liquid and the common rail pressure reservoir (2) are embodied integrally.

13. The fuel injection system according to claim 1, in which a plurality of supplementary liquid lines (13'), each leading to different dual substance nozzles, lead away from the pressure fluid container (7).

14. The fuel injection system according to claim 2, in which a plurality of supplementary liquid lines (131), each leading to different dual substance nozzles, lead away from the pressure fluid container (7).

15. The fuel injection system according to claim 3, in which a plurality of supplementary liquid lines (13'), each leading to different dual substance nozzles, lead away from the pressure fluid container (7).

16. The fuel injection system according to claim 5, in which a plurality of supplementary liquid lines (13'), each leading to different dual substance nozzles, lead away from the pressure fluid container (7).

17. The fuel injection system according to claim 9, in which a plurality of supplementary liquid lines (13'), each leading to different dual substance nozzles, lead away from the pressure fluid container (7).

18. The fuel injection system according to claim 13, in which for charging an entire group of dual substance nozzles (3) with supplementary liquid, only a single valve unit is provided.

19. The fuel injection system according to claim 14, in which for charging an entire group of dual substance nozzles (3) with supplementary liquid, only a single valve unit is provided.

20. The fuel injection system according to claim 15, in which for charging an entire group of dual substance nozzles (3) with supplementary liquid, only a single valve unit is provided.

* * * * *